US006186330B1

(12) United States Patent
Yoshimura

(10) Patent No.: US 6,186,330 B1
(45) Date of Patent: Feb. 13, 2001

(54) SHOCK ABSORBER

(75) Inventor: Naomi Yoshimura, Tokyo (JP)

(73) Assignee: Sony Corporation, Tokyo (JP)

( * ) Notice: Under 35 U.S.C. 154(b), the term of this patent shall be extended for 0 days.

(21) Appl. No.: 09/394,629

(22) Filed: Sep. 13, 1999

(30) Foreign Application Priority Data

Sep. 14, 1998 (JP) ..... 10-260179

(51) Int. Cl.[7] ..... B65D 81/02
(52) U.S. Cl. ..... 206/594; 206/320; 206/723
(58) Field of Search ..... 206/320, 701, 206/521, 591–594, 722, 723, 724, 725, 576

(56) References Cited

U.S. PATENT DOCUMENTS 1,929,918 * 10/1933 Dreyer et al. ..... 206/591
2,984,399 * 5/1961 Gaulke ..... 206/591
4,840,277 * 6/1989 Waldner ..... 206/591
5,339,958 * 8/1994 Taravella et al. ..... 206/521
5,341,934 * 8/1994 Hsu ..... 206/591
5,398,808 * 3/1995 Chen et al. ..... 206/320
5,772,025 * 6/1998 Chen et al. ..... 206/320
5,979,659 * 11/1999 Kataoka ..... 206/320

* cited by examiner

*Primary Examiner*—Luan K. Bui
(74) *Attorney, Agent, or Firm*—Jay H. Maioli

(57) ABSTRACT

A shock absorber which is put in a storage box, including: a main body portion having an accommodation portion on which a product to be accommodated in the storage box is put; at least one shock absorption portion which is provided to the main body portion and supports the product put on the accommodation portion; and a shock absorption guide portion which is provided to the main body portion and guides the shock absorption portion when the shock absorption portion is deformed.

9 Claims, 5 Drawing Sheets

(PRIOR ART)

SHOCK ABSORBER

BACKGROUND OF THE INVENTION

1. Field of the Invention

The present invention relates to a shock absorber, and particularly to a shock absorber mounted in a storage box or packaging box.

2. Description of the Related Art

A corrugated cardboard cushion has been used to moderate damages to a product due to falling of a packaging box or storage box when the product is distributed while accommodated in the packaging or storage box.

FIG. 1 is a perspective view showing a conventional corrugated cardboard cushion.

The corrugated cardboard cushion comprises a flat face portion 101 for supporting a product (not shown), and side face portions 103, 105 linked to both the sides of the flat face portion 101. When a projecting portion of the product interferes in (locally abuts against) the flat face portion 101, holes 107, 109, for example, are formed in the flat face portion 101 to avoid such interference. When an external force is applied to the product in a direction indicated by an arrow in FIG. 1, the flat face portion 101 of the corrugated cardboard cushion is folded in accordance with the external force, whereby the corrugated cardboard cushion exhibits its shock absorption effect.

FIG. 2(A) is a perspective view showing another conventional corrugated cardboard cushion, and FIG. 2(B) is an exploded perspective view of the corrugated cardboard cushion of FIG. 2(A). The corrugated cardboard cushion shown in FIGS. 2(A) and 2(B) comprises a flat face portion 101 on which a product (not shown) is put, side face portions 103, 105 linked to both the sides of the flat face portion 101, and side face portion 111 and 113 which are perpendicularly linked to each of the flat face portion 101 and the side face portions 103 and 105, the side face portions 111 and 113 having linear end portions 111*a* and 113*a* on which the product is actually put. When an external force is applied to the product in an direction indicated by an arrow in FIG. 2(A), the side face portions 111, 113 having the linear end portions 111*a*, 113*a* are crushed, thereby exhibiting a shock absorption effect.

In the corrugated cardboard cushion shown in FIG. 1 and other conventional similar corrugated cardboard cushions, the product is supported on the flat face portion 101 of the cushion while the projecting portions of the product are inserted into the holes 107, 109 to avoid the interface (local abutting), thereby exhibiting the shock absorption effect on the product. Therefore, when a product having a number of projecting portions is mounted on such a corrugated cardboard cushion, the number of clearance portions such as holes or the like is increased, so that it is difficult to exhibit the shock absorption effect.

In the corrugated cardboard cushion shown in FIGS. 2(A) and 2(B) and other conventional similar corrugated cardboard cushions, when an external force is applied to a product, the side face portions 111, 113 having the linear end portions 111*a*, 113*a* are crushed, thereby exhibiting the shock absorption effect on the product. However, it is difficult to crush the linear end portions (113*a*, 113*b*, 111*a*, 111*b*) stably, so that dispersion of the absorption effect is liable to occur.

FIG. 3(A) is a cross-sectional view showing a part of an arrangement of a corrugated cardboard cushion and a product when the product is put on the side face portions having linear end portions of the cushion. FIG. 3(B) is a cross-sectional view showing a state where the side face portions are ideally crushed due to an external force applied to the product shown in FIG. 3(A), whereby the cushion exhibits a shock absorption effect on the product. FIG. 3(C) is a cross-sectional view showing a state where the side face portions tilt and fall due to an external force applied on the product and thus no shock absorption effect is exhibited on the product.

As shown in FIG. 3(B), for example when an external force is applied to a product 115 due to falling of a packaging box or the like, the sufficient shock absorption effect could be exhibited if the side face portions 113 are crushed in parallel to the side faces thereof. However, in many cases, the side face portions 113 tilt and fall as shown in FIG. 3(C) and thus no sufficient shock absorption effect is exhibited.

SUMMARY OF THE INVENTION

It is therefore an object of the.present invention to provide a shock absorber which resolves the above-mentioned problem.

According to an aspect of the present invention, there is provided a shock absorber which is accommodated in a storage box and comprises: a main body portion for mounting thereon a product to be accommodated in the storage box; at least one shock absorption portion which is provided to the main body portion and supports the product to be accommodated in the storage box; and a shock absorption guide portion which is provided to the main body portion and guides the shock absorption portion when the shock absorption portion is deformed.

According to another aspect of the present invention, there is provided a shock absorber which is accommodated in a storage box and comprises: a main body portion designed to have a substantial frame structure and having a recess for mounting therein a product to be accommodated in the storage box; at least one shock absorption portion which is provided to the main body portion and supports the product to be accommodated in the storage box; and a shock absorption guide portion which is provided to the main body portion and guides the shock absorption portion when the shock absorption portion is deformed.

DETAILED DESCRIPTION OF THE PREFERRED EMBODIMENT

A corrugated cardboard cushion according to a preferred embodiment according to the present invention will be described hereunder with reference to the accompanying drawings.

The corrugated cardboard cushion is mounted in a packaging box, a vanity case or a storage box in advance when an electronic product or an article is put therein. According to the present invention, a product or article is supported by the corrugated cardboard cushion of the present invention while the corrugated cardboard cushion is put in a packaging box or the like, whereby shock or impact applied externally can be absorbed.

Figure 4:
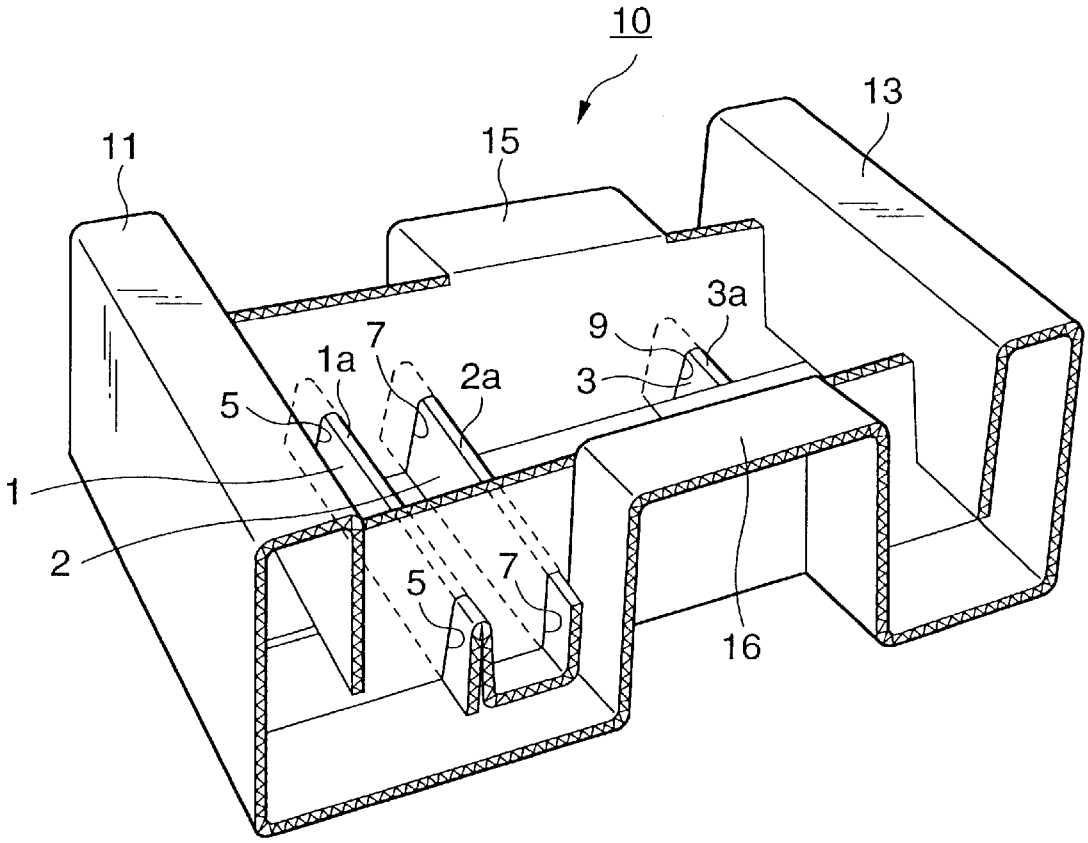
FIG. 4 is a perspective view showing a corrugated cardboard cushion according to an embodiment of the present invention.
Figure 5:
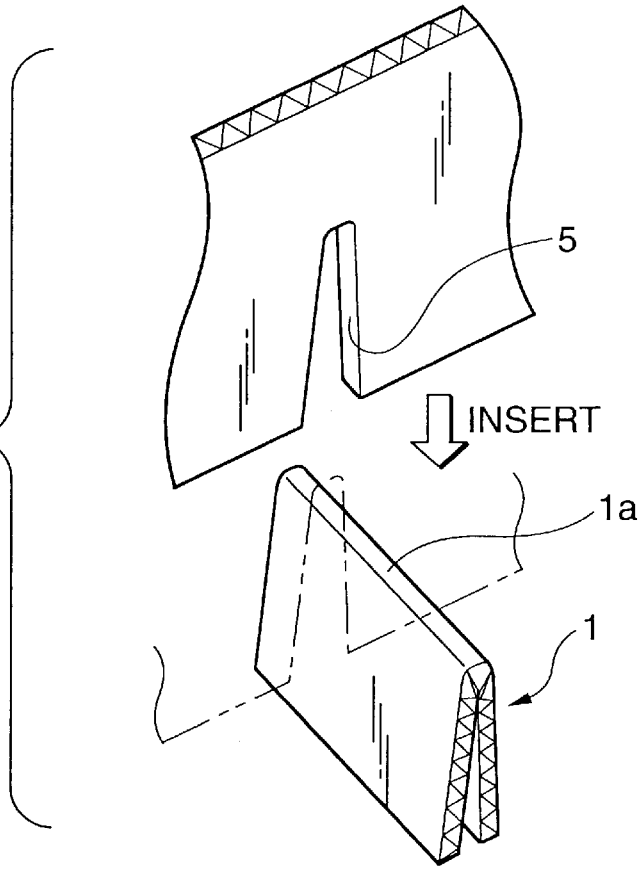
FIG. 5 is a perspective view showing a method of fabricating the main part of the corrugated cardboard cushion shown in FIG. 4.

FIG. 4 shows a corrugated cardboard cushion 10 according to an embodiment of the present invention. The corrugated cardboard cushion 10 of this embodiment is formed by forming incisions in a sheet of corrugated cardboard and then folding the corrugated cardboard so that the corrugated cardboard is fabricated in a hollow frame structure or a substantial frame structure having a recess portion at the center portion. The corrugated cardboard cushion 10 thus fabricated comprises a left-side wall portion 11, a right-side wall portion 13, a rear-side wall portion 15 and a front-side wall portion 16. The inner space defined by the side wall portions 11, 13, 15, 16 is arranged to have a recess portion in which an electronic product or an article (not shown) is stored (accommodated). Shock absorbers as described later are disposed in the recess portion so as to project upwardly as shown in FIG. 4, and an electronic product or an article is put on the shock absorbers. The inner space defined by the side wall portions 15 and 16 is provided with shock absorbers 1, 2 and 3 having linear end portions 1*a*, 2*a* and 3*a* respectively on which an electric product or an article is placed, and shock absorption guides 5, 7 and 9 for supporting the shock absorbers 1, 2 and 3 so as to prevent them from tilting and falling. In this case, as shown in FIG. 5, the shock absorption guides 5, 7 and 9 are notched in a groove shape at the lower sides thereof to engage with the shock absorbers 1, 2 and 3. The shock absorbers 1, 2 and 3 are formed by folding a sheet of corrugated cardboard as shown in FIG. 4, and then fixed to the side rear and front side wall portions 15 and 16 by inserting them into the shock absorption guides (notches) 5, 7 and 9, respectively.

Figure 7A:
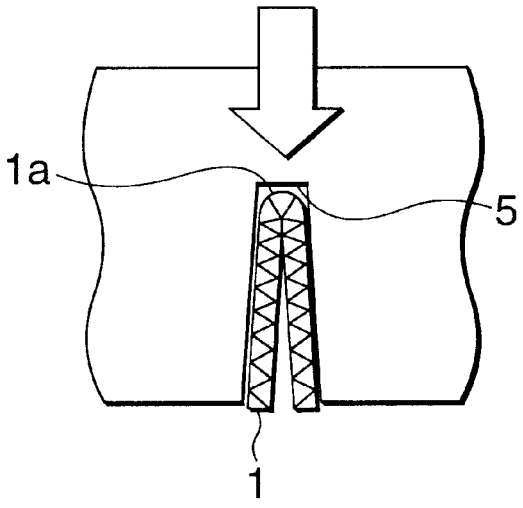
FIGS. 7(A) and 7(B) are schematic diagrams showing deformation of a shock absorber when the cushion portion shown in FIG. 5 exhibits a shock absorption effect.

As shown in FIG. 5, the shock absorber 1 is formed by erecting the folded corrugated cardboard substantially vertically to the bottom face of the cushion. The ridgeline of the fold portion is located at the uppermost position of the shock absorber 1, and it serves as the linear end portion 1*a* for supporting a product or article. The shock absorption guides 5, 9 are constructed by the grooves (notches) formed at one end sides (in this case, the lower end sides) of the plate-shaped corrugated cardboard sheets which constitute the side wall portions 15, 16. The shock absorption guide 5 has substantially the same section as the shock absorber 1. That is, each of the shock absorption guides 5, 9 is designed like a groove having a substantially trapezoidal shape so that the width at the open end side (lower end side) of the shock absorption guide 5,9 is larger than the width at the upper end side thereof which confronts the end portion 1*a*, 3*a* as shown in FIG. 5 or FIG. 7(A), and the length of the shock absorption guide 5, 9 is set to be equal to or slightly shorter than the length of the shock absorber 1,3. Accordingly, the shock absorber 1,3 is inserted into the shock absorption guide 5,9 so that both the side surfaces thereof are partially sandwiched by the shock absorption guide 5,9 to prevent the shock absorbers 1,3 from spreading out, thereby forming the cushion portion exhibiting the shock absorption effect.

Figure 6:
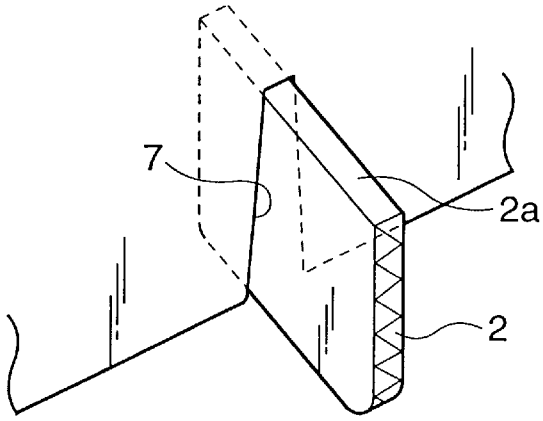
FIG. 6 is a perspective view showing a cushion portion shown in FIG. 4;.

The shock absorber 2 is formed by a sheet of corrugated cardboard without folding the sheet, and it is inserted into the shock absorption guides 7 formed in the side wall portions 15, 16 so as to erect substantially vertically to the bottom face of the sheet. The shock absorber 2 shown in FIG. 6 has the same shock absorption effect as the shock absorbers 1,3 shown in FIG. 5. In the case of FIG. 6, the shock absorption guide 7 is formed by a groove formed at one end portion, that is, the lower end portion of each of the side wall portions 15, 16. The shock absorption guide 7 has substantially the same section as the shock absorber 2, and the length of the shock absorption guide 7 is set to be equal to or slightly shorter than the length of the shock absorber 2.

FIGS. 7(A) and (B) show a deformation process of the shock absorber 1 when the cushion portion comprising the shock absorption guide 5 and the shock absorber 1 shown in FIG. 5 of the corrugated cardboard exhibits the shock absorption effect. The following description is made on the shock absorber 1, however, the same is basically applied to the shock absorbers 2 and 3.

Figure 7B:
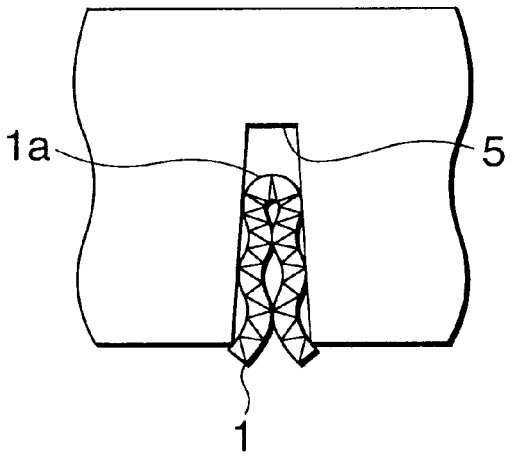

When a corrugated cardboard cushion 10 is put into a packaging box and a storage target such as an electronic product, an article or the like is mounted on the corrugated cardboard cushion 10, a part of the storage target is put on the linear end portion 1*a* of the shock absorber 1 as shown in FIG. 7(A). That is, the storage target is supported by the linear end portion 1*a*. If an external force is applied to the product accommodated in the packaging box in the direction indicated by an arrow in FIGS. 7(A) and 7(B) due to falling of the packaging box or the like, as shown in FIG. 7(B), the shock absorber 1 is deformed by the impact or the external force applied to the storage target due to the falling of the packaging box. At this time, the shock absorber 1 is deformed or crushed along the shock absorption guide 5.

According to the above embodiment, the shock absorbers 1, 2 and 3 are stably deformed or crushed by the shock absorption guides 5, 7 and 9, so that a constant shock absorption effect can be obtained with no dispersion among the cushions. That is, a corrugated cardboard cushion having a high shock absorption effect can be designed with high precision.

Further, since the product can be linearly supported by the linear end portions 1*a*, 2*a* and 3*a* of the shock absorbers 1, 2 and 3, the present invention can easily support an article having a complicated uneven surface such as an article having a button, a knob, a jack or the like, and exhibit a sufficient shock absorption effect. Since the shock absorbers 1,2 and 3 have the linear end portions 1*a*, 2*a* and 3*a* and an electronic product or an article to be stored or accommodated in the packaging box or storage box is supported by the linear end portions 1*a*, 2*a* and 3*a*. Therefore, as compared with a case where the article or the like is supported by a large face, the shock absorbers 1,2 and 3 can be more easily deformed and crushed, so that the sufficient shock absorption effect can be exhibited even when a small impact or external force is applied to the packaging box or storage box.

The corrugated cardboard cushion 10 shown in FIG. 4 has three shock absorbers 1, 2 and 3. However, the number of shock absorbers is not limited to three. By properly reducing or increasing the number of shock absorbers, the present invention can support mass-eccentric products and other various products from light products to heavy products, and thus it is expected that the sufficient shock absorption effect can be exhibited.

In the embodiment shown in FIG. 4, the shock absorbers are provided so as to project from the bottom face of the recess portion of the corrugated cardboard cushion 10 in which a product or article is accommodated. However, the shock absorbers may be provided so as to project from the side faces of the corrugated cardboard cushion 10.

In the above embodiment, the overall body of the corrugated cardboard cushion 10 is formed by using corrugated cardboard. However, if at least shock absorber which supports a product (article) and exhibits a shock absorption effect is formed of corrugated cardboard, the other parts may be formed of material other than the corrugated cardboard.

Further, the shock absorbers 1, 2 and 3 are formed of corrugated cardboard. However, they may be formed of any other material than corrugated cardboard such as thick paper or the like which is easily deformed insofar as the they are deformed or crushed along the shock absorption guides 5, 7 and 9 when an external force is applied to the product (article) and exhibit the shock absorption effect.

Figure 1:
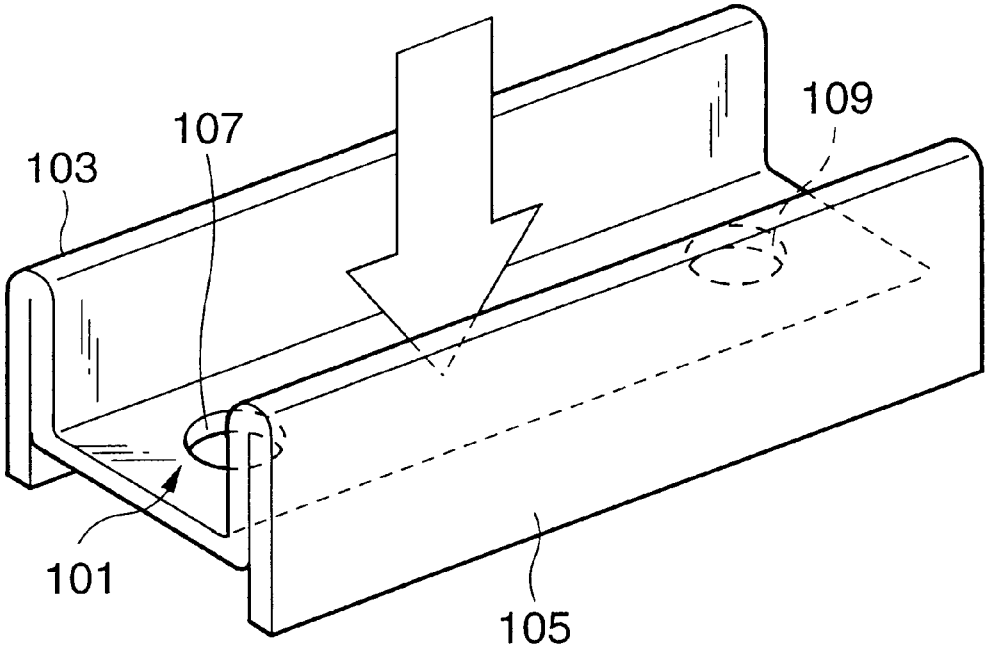
FIG.1 (PRIOR ART)
FIG. 1 is a perspective view showing a conventional corrugated cardboard cushion.
Figure 2A:
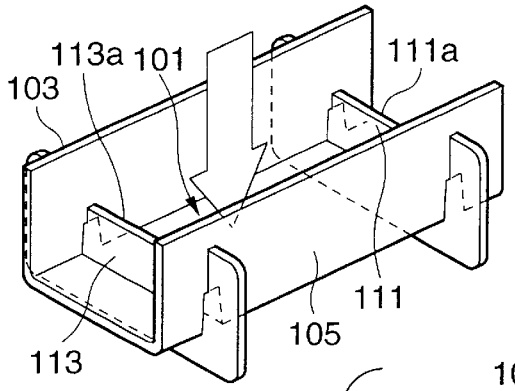
FIG.2(A) (PRIOR ART)
FIGS. 2(A) is a perspective view showing another conventional corrugated cardboard cushion.
Figure 2B:
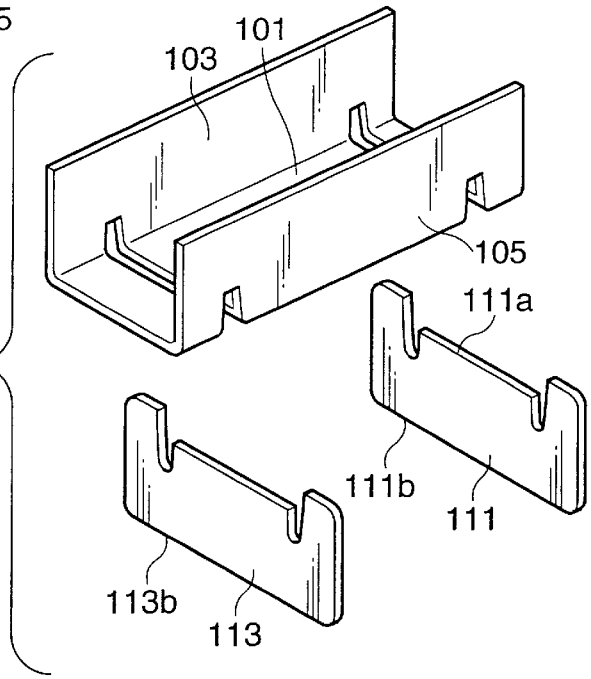
FIG.2(B) (PRIOR ART)
FIG. 2(B) is an exploded perspective view showing the corrugated cardboard cushion shown in FIG. 2(A)
Figures 3A, 3B, 3C:
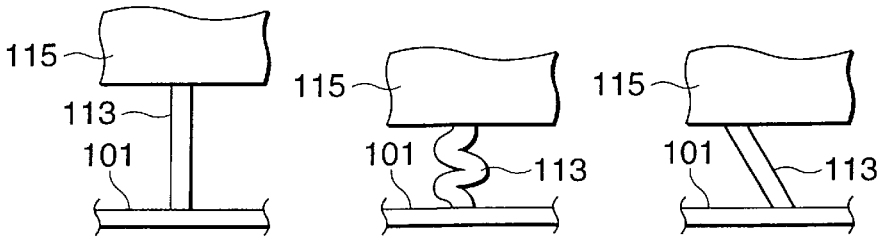
FIGS. 3(A) is a cross-sectional view showing a state where a product is put on the side face portions having the linear end portions of the corrugated cardboard cushion shown in FIGS. 2(A) and 2(B)
FIG. 3(B) is a cross-sectional view showing a state where the side face portions shown in FIG. 3(A) are ideally crushed.
FIG. 3(C) is a cross-sectional view showing a state where the side face portions shown in FIG. 3(A) tilt and fall.

In the above embodiment, the shock absorption guide is designed so as to sandwich the shock absorber from both the sides. However, insofar as the shock absorbers are not deformed in the shape shown in FIG. 3(C), but deformed or crushed in the shape shown in FIG. 3(B), the shape of the shock absorption guide may be set to a shape other than the shape of the above embodiment.

What is claimed is:

1. A shock absorber for placement in a storage box, comprising:

a main body portion having an accommodation portion in which a product to be accommodated in said storage box is placed;

at least one shock absorption portion which is provided to said main body portion and having a linear end portion for solely supporting the product accommodated in said accommodation portion; and a shock absorption guide portion which is provided on said main body portion for guiding each of said at least one shock absorption portion when said shock absorption portion is deformed by a shock force.

2. The shock absorber as claimed in claim 1, wherein said shock absorption portion is formed in an inverted V-shape in cross section with a pointed end of said V-shape forming said linear end portion.

3. The shock absorber as claimed in claim 2, wherein said shock absorption portion is formed by folding a corrugated cardboard sheet.

4. The shock absorber as claimed in claim 1, wherein said shock absorption portion is arranged to project into said accommodation portion of said main body portion, and said shock absorption guide portion guides said shock absorption portion so that said shock absorption portion is deformed in a direction parallel to a projecting direction of said shock absorption portion into said accommodation portion.

5. The shock absorber as claimed in claim 1, wherein said shock absorption portion is inserted in said shock absorption guide portion so as to be provided on said main body portion.

6. A shock absorber which is accommodated in a storage box, comprising:

a main body portion having a substantial frame structure and having a recess for mounting therein a product to be accommodated in said storage box;

at least one shock absorption portion which is provided on said main body portion formed in an inverted V-shape in cross section and having a linear end portion for solely supporting the product mounted in said recess of said main body portion; and a shock absorption guide portion which is provided to said main body portion for guiding said shock absorption portion when said shock absorption portion is deformed by a shock force.

7. The shock absorber as claimed in claim 6, wherein said shock absorption portion is formed by folding a corrugated cardboard sheet.

8. The shock absorber as claimed in claim 6, wherein said shock absorption portion is arranged to project into said recess, and said shock absorption guide portion guides said shock absorption portion so that said shock absorption portion is deformed in a direction parallel to a projecting direction of said shock absorption portion into said recess.

9. The shock absorber as claimed in claim 8, wherein said shock absorption portion is inserted in said shock absorption guide portion so as to be provided on said main body portion.

* * * * *